US006767882B1

(12) United States Patent
Jagannath et al.

(10) Patent No.: US 6,767,882 B1
(45) Date of Patent: Jul. 27, 2004

(54) PROCESS FOR PRODUCING COATED DETERGENT PARTICLES

(75) Inventors: Girish Jagannath, Kobe (JP); Manivannan Kandasamy, Kobe (JP); Ganapathy Venkata Ramanan, Kobe (JP); Eric San Jose Robles, Kobe (JP); Kenji Shindo, Kobe (JP); Tomotaka Inoue, Kobe (JP)

(73) Assignee: The Procter & Gamble Company, Cincinnati, OH (US)

( * ) Notice: Subject to any disclaimer, the term of this patent is extended or adjusted under 35 U.S.C. 154(b) by 195 days.

(21) Appl. No.: 09/979,530

(22) PCT Filed: Jun. 20, 2000

(86) PCT No.: PCT/US00/16918

§ 371 (c)(1),
(2), (4) Date: Jan. 18, 2002

(87) PCT Pub. No.: WO00/78909

PCT Pub. Date: Dec. 28, 2000

Related U.S. Application Data

(60) Provisional application No. 60/140,093, filed on Jun. 21, 1999.

(51) Int. Cl.[7] ..... C11D 17/00

(52) U.S. Cl. ..... 510/441; 510/438; 510/442; 510/444

(58) Field of Search ..... 510/438, 441, 510/442, 444

(56) References Cited

FOREIGN PATENT DOCUMENTS

| | | | |
|---|---|---|---|
| DE | 44 35 743 A1 | | 8/1995 |
| DE | 19524287 | * | 9/1997 |
| WO | WO 90/15856 A1 | | 12/1990 |
| WO | WO 98/24876 A1 | | 6/1998 |
| WO | WO 00/24863 A1 | | 5/2000 |

* cited by examiner

*Primary Examiner*—Margaret Einsmann
(74) *Attorney, Agent, or Firm*—Brahm J. Corstanie; Kim William Zerby; Steven W. Miller

(57) ABSTRACT

A process for preparing detergent particles having a coating layer of water-soluble inorganic material is provided. The detergent particle comprises a particle core of a detergent active material. This particle core is then at least partially covered by a particle coating layer of a water soluble inorganic material. Particularly preferred are non-hydrate inorganic coating materials including double salt combinations of alkali metal carbonates, and sulfates. The particle coating layer may also include detergent adjunct ingredients such as brighteners, chelants, nonionic surfactants, co-builders, etc. The process includes the steps of passing the particle core through a coating mixer such as a low speed mixer of fluid bed mixer and coating the particle core with a coating solution or slurry of the water soluble inorganic material. Upon drying, the resultant detergent particles have improved appearance, flow properties, and improved solubility, and may be packaged and sold as a detergent material or mixed with various other detergent ingredients to provide a fully formulated detergent composition.

13 Claims, No Drawings

PROCESS FOR PRODUCING COATED DETERGENT PARTICLES

This application claims the benefit of Provisional application Ser. No. 60/140,093, filed Jun. 21, 1999.

FIELD

The present invention relates to detergent particles and a process for producing the particles. More particularly, the present invention relates to a process for producing coated detergent particles.

BACKGROUND

Recently, there has been considerable interest within the detergent industry for laundry detergents which have the convenience, aesthetics and solubility of liquid laundry detergent products, but retain the cleaning performance and cost of granular detergent products. The problems, however, associated with past granular detergent compositions with regard to aesthetics, solubility and user convenience are formidable. Such problems have been exacerbated by the advent of "compact" or low dosage granular detergent products which typically do not dissolve in washing solutions as well as their liquid laundry detergent counterparts. These low dosage detergents are currently in high demand as they conserve resources and can be sold in small packages which are more convenient for consumers prior to use, but less convenient upon dispensing into the washing machine as compared to liquid laundry detergent which can be simply poured directly from the bottle as opposed to "scooped" from the box and then dispensed into the washing solution.

As mentioned, such low dosage or "compact" detergent products unfortunately experience dissolution problems, especially in cold temperature laundering solutions (i.e., less than about 30° C.). More specifically, poor dissolution results in the formation of "clumps" which appear as solid white masses remaining in the washing machine or on the laundered clothes after conventional washing cycles. These "clumps" are especially prevalent under cold temperature washing conditions and/or when the order of addition to the washing machine is laundry detergent first, clothes second and water last (commonly known as the "Reverse Order Of Addition" or "ROOA"). Such undesirable "clumps" are also formed if the consumer loads the washing machine in the order of clothes, detergent and then water. Similarly, this clumping phenomenon can contribute to the incomplete dispensing of detergent in washing machines equipped with dispenser drawers or in other dispensing devices, such as a granulette. In this case, the undesired result is undissolved detergent residue in the dispensing device.

It has been found that the cause of the aforementioned dissolution problem is associated with the "bridging" of a "gel-like" substance between surfactant-containing particles to form undesirable "clumps." The gel-like substance responsible for the undesirable "bridging" of particles into "clumps" originates from the partial dissolution of surfactant in the aqueous laundering solutions, wherein such partial dissolution causes the formation of a viscous surfactant phase or paste which binds or otherwise "bridges" other surfactant-containing particles together into "clumps." This undesirable dissolution phenomena is commonly referred to as "lump-gel" formation. In addition to the viscous surfactant "bridging" effect, inorganic salts have a tendency to hydrate which can also cause "bridging" of particles which linked together via hydration. In particular, inorganic salts hydrate with one another to form a cage structure which exhibits poor dissolution and ultimately ends up as a "clump" after the washing cycle. It would therefore be desirable to have a detergent composition which does not experience the dissolution problems identified above so as to result in improved cleaning performance.

The prior art is replete with disclosures addressing the dissolution problems associated with granular detergent compositions. For example, the prior art suggests limiting the use and manner of inorganic salts which can cause clumps via the "bridging" of hydrated salts during the laundering cycle. Specific ratios of selected inorganic salts are contemplated so as to minimize dissolution problems. Such a solution, however, constricts the formulation and process flexibility which are necessary for current commercialization of large-scale detergent products. Various other mechanisms have been suggested by the prior art, all of which involve formulation alteration, and thereby reduce formulation flexibility. As a consequence, it would therefore be desirable to have a process by which detergent compositions having improved dissolution without significantly inhibiting formulation flexibility can be produced.

Accordingly, the need remains for a process which can produce a detergent granule having improved flow properties and aesthetics, as well as improved solubility, which may be included in detergent compositions.

SUMMARY

This need is met by the present invention wherein a process for producing a detergent particle that has improved surface, appearance, flow properties, and improved solubility is provided. The particles of the present invention have improved surface properties in that they are smoother and have a generally more uniform surface and appearance than prior art detergent particles. Further, the appearance of the particles have been improved in that they appear brighter and whiter than currently available detergent particles and have improved flow properties where the particles have reduced lumping and caking profiles.

In accordance with the present invention, a process for preparing detergent compositions including granules having a coating layer of a water-soluble material is provided. The process comprises providing detergent granules having at least one detergent active material and passing those detergent granules through a coating mixer such as a low speed mixer or fluid bed mixer and coating the particle core with a coating solution or slurry of the water soluble coating material. Upon drying, the resultant detergent particles have improved appearance and flow properties and may be packaged and sold as a detergent material or mixed with various other detergent ingredients to provide a fully formulated detergent composition.

The water soluble coating material is selected from the group consisting of detersive surfactants such as anionic surfactants, hydrotropes such as sulfonates, polyethylene glycols and polypropylene glycols and mixtures thereof. In preferred embodiments, the coating material is a mixture of an anionic surfactant and a hydrotrope in a ratio of anionic surfactant to hydrotrope of from about 95:5 to about 5:95. Particularly preferred are (a) a mixture of sodium linear alkyl benzene sulfonate, hydrophobic secondary alkyl sulfate, and/or sodium xylene sulfonate or (b) a mixture of sodium linear alkyl benzene sulfonate, hydrophobic secondary alkyl sulfate, and/or disodium alkyldiphenyloxide disulfonate (commercially known as Dowfax hydrotrope with the alkyl group having a chainlength from C1–C10), at a ratio of surfactants to hydrotrope of from about 70:30 to about 95:5. Preferably, the amount of water-soluble solution is from about 1% to about 30%, by weight, of the detergent composition. Alternatively, coating material and thus the particle coating layer may also include detergent adjunct ingredients such as brighteners, chelants, nonionic surfactants, co-builders, etc incorporated into the coating.

In an optional embodiment of the present process, the process further comprises the steps of mixing the coated detergent granules with a flow control aid to adhere the flow control aid to the surface of the granules. The flow control aid is preferably an inorganic powder material with a mean particle size of less than about 100 microns and is selected from the group consisting of crystalline layered silicate, carbonate, sodium sulfate, aluminosilicate, magnesium silicate, calcium silicate, clay, and mixtures thereof.

Accordingly, it is an object of the present invention to provide a process for producing a detergent composition having improved appearance and flow characteristics by coating detergent granules with a layer of a water soluble materials. It is a further object of the present invention to provide a process for preparing the detergent particle via coating in a mixer with solutions or slurries of the inorganic materials. These and other objects features and advantages of the present invention will become apparent to those skilled in the art from a reading of the following detailed description and the appended claims.

DETAILED DESCRIPTION

Definitions

As used herein, the word "particles" means the entire size range of a detergent final product or component or the entire size range of discrete particles, agglomerates, or granules in a final detergent product or component admixture. It specifically does not refer to a size fraction (i.e., representing less than 100% of the entire size range) of any of these types of particles unless the size fraction represents 100% of a discrete particle in an admixture of particles. For each type of particle component in an admixture, the entire size range of discrete particles of that type have the same or substantially similar composition regardless of whether the particles are in contact with other particles. For agglomerated components, the agglomerates themselves are considered as discrete particles and each discrete particle may be comprised of a composite of smaller primary particles and binder compositions.

As used herein, the phrase "geometric mean particle diameter" means the geometric mass median diameter of a set of discrete particles as measured by, any standard mass-based particle size measurement technique, preferably by dry sieving. As used herein, the phrase "geometric standard deviation" or "span" of a particle size distribution means the geometric breadth of the best-fitted log-normal function to the above-mentioned particle size data which can be accomplished by the ratio of the diameter of the 84.13 percentile divided by the diameter of the $50^{th}$ percentile of the cumulative distribution ($Da_{84.13}/D_{50}$); See Gotoh et al, *Powder Technology Handbook*, pp. 6–11, Marcel Dekker 1997.

As used herein, the phrase "builder" means any inorganic material having "builder" performance in the detergency context, and specifically, organic or inorganic material capable of removing water hardness from washing solutions. As used herein, the term "bulk density" refers to the uncompressed, untapped powder bulk density, as measured by pouring an excess of powder sample through a funnel into a smooth metal vessel (e.g., a 500 ml volume cylinder), scraping off the excess from the heap above the rim of the vessel, measuring the remaining mass of powder and dividing the mass by the volume of the vessel.

As used herein, "composition" and "granular detergent composition" are intended to include both final products and additives/components of a detergent composition. That is, the compositions produced by the processes claimed herein may be complete laundry detergent compositions or they may be additives that are used along with other detergent ingredients for laundering fabrics and the like.

As used herein, "surface area" mean the total amount of surface of a powder available for gas adsorption and thus includes both internal (i.e. that within cracks and crevices) and external surface area. Surface area is measured using BET multi point surface area analysis.

The process of the present invention involves the production of coated detergent granules for incorporation into a detergent composition The process comprises in general, providing detergent granules. The detergent granules of the present invention comprise at least one detergent active material and are preferably selected from spray-dried detergent granules, wet detergent agglomerates, dry detergent agglomerates and dry detergent ingredients such as enzyme, bleach, perfumes, detergent adjunct ingredients or other granules typically incorporated into a detergent composition. The granules may be in particle, agglomerate or flake form.

Detergent adjunct ingredients includes but is not limited to, carbonates, phosphates, sulfates, zeolites or the like. Of course, other conventionally known ingredients may be included as well. Spray-dried detergent granules include those particles which are manufactured via a conventional spray-drying technique wherein a slurry of detergent materials is prepared and, sprayed downward into a upwardly flowing stream of gas to dry the particles. A dry free flowing material is produced from the process. Wet agglomerates include those particles that are manufactured via a granulation type process wherein detergent adjunct ingredients such as described below are admixed with a liquid binder material such as surfactant or a precursor thereof in at least one mixer to form granules of detergent materials. These particles are known as "wet agglomerates" until dried and as "dry agglomerates" upon exiting a drying stage, and optionally other conditioning stages such as sizing, grinding and cooling. Binders include but are not limited to water, anionic surfactants and their precursors, nonionic surfactants, cationic surfactants, polyethylene glycol, polyvinyl pyrrolidone, polyacrylates, citric acid, and mixtures thereof.

Spray dried granules include those particles which are manufactured via a conventional spray-drying technique wherein a slurry of detergent materials is prepared and sprayed downward into an upwardly flowing stream of gas to dry the particles. A dry, free flowing material is produced from the process. For example, the slurry is passed to a tower where the slurry is sprayed into a stream of air at temperatures ranging from about 175° C. to about 450° C. to dry the detergent slurry and form detergent particles. Typically, resultant densities of these particles range from about 200 to about 650 g/l.

Accordingly, the present invention entails the introduction of both raw material or the introduction of previously formed detergent granules for continued processing of the granules. In a one preferred embodiment of the present invention, the granular feed stream comprises at least two of the differing types of granules such as spray-dried granules and wet or dry detergent agglomerates. In one highly preferred embodiment, the feed stream is comprised of spray-dried detergent granules, dry detergent agglomerates and detergent adjunct ingredients.

Detergent agglomerates of the present invention are typically formed by an agglomeration of a viscous surfactant paste or a liquid acid precursor of a surfactant and the aforementioned detergent adjunct ingredients. The agglomeration of the surfactant material and detergent adjunct material may be carried out in a coating mixer, such as a high or moderate speed mixer after which an optional low or moderate speed mixer may be employed for further agglomeration, if necessary. Alternatively, the agglomeration may be carried out in a single mixer that can be low, moderate or high speed. The particular mixer used in the present process should include pulverizing or grinding and agglomeration tools so that both techniques can be carried forth simultaneously in a single mixer.

Residence times of the mixers will vary depending on the type of mixer and the operating parameters. For a preferred high-speed mixer, the mean residence time is from about 0.1 to 60 seconds, more preferably from about 0.1 to about 30 seconds, even more preferably 0.1 to about 15 seconds. Other preferred conditions of the high-speed mixer include from about 3 to 90 m/s of tip speed, and more preferably from about 10 to 70 m/s of tip speed, and from about 0.005 W/kg to 100 W/kg of power draw, more preferably from about 0.05 W/kg to 80 W/kg of power draw. Preferably, if choppers are used, choppers can be used inside the mixer to break up undesirable oversized particles at an rpm of from about 0 to 5000 rpm, more preferably from about 100 to 3000 rpm. Preferably, the wall temperature is from ambient to about 80° C. and the spacing between the mixer elements and the wall is from about 0.1 cm to 25 cm. Examples of a high-speed mixer having a mean residence time of from about 0.1 to about 60 seconds are Lodige Recycler CB 30™, by Lodige Company, or mixers made by Drais, Schugi, or a similar brand mixer.

For a preferred moderate-speed mixer, the mean residence time is from about 30 to 1800 seconds, more preferably from about 30 to about 1200 seconds, more preferably from about 30 to about 600 seconds. Other preferred conditions of the moderate-speed mixer include from about 0.1 to 30 m/s of tip speed, and more preferably from about 1 to 25 m/s of tip speed, and from about 5 W/kg to 1000 W/kg of power draw, more preferably from about 20 W/kg to 500 W/kg of power draw. Preferably, if choppers are used, choppers can be used inside the mixer to break up undesirable oversized particles at an rpm of from about 0 to 5000 rpm, more preferably from about 100 to 4000 rpm. Preferably, the wall temperature is from about −20° C. to about 80° C. and the spacing between the mixer elements and the wall is from about 0.1 cm to 25 cm. Examples of a moderate-speed mixer having a mean residence time of from about 30 to about 1800 seconds are Lodige Recycler KM "Ploughshare" 300™ and 600™, by Lodige Company, the Drais K-T 160™ mixer, or mixers made by Fukae. The Lodige KM "Ploughshare" 600™ moderate-speed mixer is a particularly preferred mixer, which comprises a horizontal, hollow static cylinder having a centrally mounted rotating shaft around which several plough-shaped blades are attached. Preferably, the shaft rotates at a speed of from about 15 rpm to about 140 rpm, more preferably from about 80 rpm to about 120 rpm. In a preferred mixer, the grinding or pulverizing is accomplished by cutters, generally small r in size that the rotating shaft, which preferably operate at about 3600 rpm.

For a preferred low-speed mixer, the mean residence time is from about 30 seconds to about 1800 seconds, more preferably from about 30 seconds to about 1200 seconds, and even more preferably from about 30 seconds to about 600 seconds. The tip speed is preferably from about 0.1 m/s to about 10 m/s, more preferably from about 0.2 m/s to about 7 m/s, and even more preferably from about 0.2 m/s to about 3.5 m/s. Examples of preferred low-speed mixers include rotating bowl agglomerators, drum agglomerators, pan agglomerators, fluid bed granulators, and extruders. An example of an extruder is a multiple-screw extruder by Werner-Pfliedder (Germany).

In one preferred embodiment it has been found that the first processing step can be successfully completed, under the process parameters described, in a Lodige KM™ (Ploughshare) moderate speed mixer, Lodige CB™ high speed mixer, or mixers made by Fukae, Drais, Schugi or similar brand mixer. The Lodige KM™ (Ploughshare) moderate speed mixer, which is a preferred mixer for use in the present invention, comprises a horizontal, hollow static cylinder having a centrally mounted rotating shaft around which several plough-shaped blades are attached. Other mixers similar in nature which are suitable for use in the process include the Lodige Ploughshare™ mixer and the Drais® K-T 160 mixer.

This agglomeration is typically followed by an optional drying step. This drying step may be carried out in a wide variety of equipment including, but not limited to a fluid bed drying apparatus. Examples of dryer characteristics include fixed or vibrating; rectangular bed or round bed; and straight or serpentine dryers. Manufacturers of such dryers include Niro, Bepex, Spray Systems and Glatt. By way of example, apparatus such as a fluidized bed can be used for drying while an airlift can be used for cooling should it be necessary. The air lift can also be used to force out the "fine" particles so that they can be recycled to the particle agglomeration process.

The agglomeration may comprise the step of spraying an additional binder in the mixers to facilitate production of the desired detergent particles. A binder is added for purposes of enhancing agglomeration by providing a "binding" or "sticking" agent for the detergent components. The binder is preferably selected from the group consisting of water, anionic surfactants, nonionic surfactants, polyethylene glycol, polyvinyl pyrrolidone polyacrylates, citric acid and mixtures thereof. Other suitable binder materials including those listed herein are described in Beerse et al, U.S. Pat. No. 5,108,646 (Procter & Gamble Co.), the disclosure of which is incorporated herein by reference.

Another optional processing step to form the particle core of the present invention includes continuously adding a coating agent such as zeolites, recycled "fines" as described above and fumed silica to the mixer to improve the particle color, increase the particle "whiteness or facilitate free flowability of the resulting detergent particles and to prevent over agglomeration. When employing recycled fines as the coating agent, the fines are preferably in the approximate size range of 0.1 to 0.9 times the mean particle size of the larger particles. The particle coating layer will also improve the integrity of the fines layering and provide abrasion and attrition resistance during handling. In addition, the detergent starting materials can be fed into a pre-mixer, such as a Lodige CB mixer or a twin-screw extruder, prior to entering in the mixer. This step, although optional, does indeed facilitate agglomeration.

The particles of the present invention comprise at least about 50% by weight of particles having a geometric mean particle diameter of from about 400 microns to about 1500 microns and preferably have a geometric standard deviation of from about 1 to about 2. Preferably the geometric standard deviation is from about 1.0 to about 1.7, preferably from about 1.0 to about 1.4. The granular detergent composition resulting from the processes may comprise undersized or fine particles, wherein "fine particles" are defined as particles that have a geometric mean particle diameter that is less than about 1.65 standard deviations below the chosen geometric mean particle diameter of the granular detergent composition at a given geometric standard deviation. Oversized or large particles may also exist wherein "large particles" are defined as particles that have a geometric mean particle diameter that is greater than about 1.65 standard deviations above the chosen geometric mean particle diameter of the granular detergent composition at a given geometric standard deviation. The fine particles are preferably separated from the granular detergent composition and returned to the process by adding them to at least one of the mixers and/or the fluid bed dryer as described in detail below. Likewise, the large particles are preferably separated from the granular detergent composition and then fed to a grinder where their geometric mean particle diameter is reduced. After the geometric mean particle diameter of the large particles is reduced, the large particles are returned to the process by adding them to at least one of the mixers and/or the fluid bed dryer.

Particle Coating Layer

As described hereinbefore, detergent compositions of the present invention comprises granules that have been at least partially coated with a water soluble coating material thereby forming a water soluble coating layer on the granules. The particle coating layer imparts dramatically new surface and appearance properties on the granules of the present invention. The coated granules of the present invention have an appearance which is brighter and/or whiter than current detergent particles. This provides a more favorable response from consumers who prefer white detergent products.

Most importantly, the coated particles of the present invention provide improved clumping and flowability profiles to detergent products containing the particles of the present invention. The particle coating layer provides a coating which is crisper and non-tacky. While effective at improving flowability in all detergent products, it is particularly effective at preventing clumping in products containing surfactants which are more difficult to dry to a non-tacky state including nonionic surfactants, linear alkyl benzene sulfonates ("LAS"), and ethoxylated alkyl sulfates or in detergent products containing high amounts of surfactant actives (i.e. greater than about 25 wt % surfactant active).

The particle coating layer of the present invention at least partially coats the granule. While the desired state is for granules which are completely coated by the particle coating, it is, of course, anticipated that complete coverage will not be possible in all cases in a continuous, high speed manufacturing process. While it is rather difficult to quantify the extent of the coating layer coverage, it is observed that increasing the amount of coating solids, either by increasing the solids concentration in the solution or by spraying on more of the solution, results in improved benefits and the appearance of a more uniform coverage. The benefits of increased coverage is balanced with the cost of drying excess water in the process. Accordingly, in preferred embodiments of the present invention, adequate coverage is achieved by applying coating solids at more than about 1 wt. % and most preferably more than about 5 wt. % of the uncoated granule mass or in an amount of from about 1% to about 30% by weight of the finished detergent composition.

The particle coating layer of the present invention comprises a water soluble coating material. In preferred embodiments the coating material is selected from the group consisting of detersive surfactants such as anionic surfactants, hydrotropes and mixtures thereof The hydrotropes of the present invention are preferably selected from sulfonates salts such as alkali metal sulfonates in particular sodium xylene sulfonate, sodium toluene sulfonate, sodium cumene sulfonate, disodium alkyldiphenyloxide disulfonate (commercially known as Dowfax hydrotrope with the alkyl group having a chainlength from C1–C10), hydrophobic secondary alkyl sulfate, and sodium 3,5-diisopropylbenzenesulfonate; polyethylene glycols having a molecular weight of from about 200 to about 8000 and polypropylene glycols having a molecular weight of from about 200 to about 8000. When hydrotropes are employed as the coating material the hydrotrope is preferably present in an amount of from about 1% to about 20%, more preferably about 2% to about 15% and most preferably about 3% to about 10% by weight of the finished detergent composition.

The surfactants of the present invention may include anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat. No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimiting examples of surfactant for use in the coating of the present invention include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl; ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. Hydrophobic secondary alkyl sulfates are also preferred. When surfactants are employed as the coating material, the surfactant is preferably present in an amount of from about 1% to about 30%, more preferably about 3% to about 20% and most preferably about 5% to about 10% by weight of the finished detergent composition.

In preferred embodiments, the coating material comprises a mixture of anionic surfactants and hydrotropes. Ratios of the surfactant to hydrotrope preferably from about 95:5 to about 5:95 and more preferably range from about 90:10 to about 10:90. When mixtures are employed as the coating material, the mixture is preferably present in an amount of from about 1% to about 30%, more preferably about 3% to about 20% and most preferably about 3% to about 15% by weight of the finished detergent composition. Particularly preferred are (a) a mixture of sodium linear alkyl benzene sulfonate and/or hydrophobic secondary alkyl sulfate and sodium xylene sulfonate or (b) a mixture of sodium linear alkyl benzene sulfonate, hydrophobic secondary alkyl sulfate, and/or disodium alkyldiphenyloxide disulfonate (commercially known as Dowfax hydrotrope with the alkyl group having a chainlength from C1–C10), at a ratio of from surfactant to hydrotrope from about 70:30 to about 95:5. The preferred viscosity range for the coating solution or slurry during application ranges from about 50 to about 100,000 centipoise, more preferably from about 100 to about 50,000 cp, and most preferably from about 300 to about 30,000 cp at 60 deg.C.

The particle coating layer may also include an detergent supplement in addition to the particle coating material. These detergent supplement may include a wide variety of ingredients, including but not limited to optical brighteners, pigments or dyes, chelants, nonionic surfactants, pH control agents, detergency co-builders, fillers and mixtures of these materials. Particularly preferred are pigments or dyes such as titanium dioxide, bluing agents such as copper sulfate, zinc thiosulfate and Ultramarine blue, Sparkle enhancers such as mica flake, fillers such as sodium carbonate and sodium sulfate and co-builders such as citrates and nonionic surfactants.

The granules of the present invention are produced by coating the granules as described hereinbefore with the particle coating material in a coating mixer. The coating mixer may be any of a number of mixers including high, moderate, and low speed mixers such as a Lodige KM™ (Ploughshare) moderate speed mixer, Lodige CB™ high speed mixer, or mixers made by Fukae, Drais, Schugi or similar brand mixer, as described in detail above. Particularly preferred for use in the present invention are low speed drum mixers and low shear fluidized bed mixers. When employing a low speed drum mixer in the present invention, the mixer is preferably followed in sequence by a drying apparatus, for example a fluid bed or air lift, wherein the coated particles are then dried to achieve the coated particles of the present invention. The drying step, however, is optional.

In a preferred embodiment of the present invention, the coating mixer is a fluidized bed, or is used in combination with any of the mixers described above. In one preferred embodiment, the distribution of coating between the mixer and fluid beds can be in a ratio of 100:0 to 5:95. The preferred granules of detergent agglomerates, spray-dried granules or most preferably mixtures thereof is passed into a fluid bed dryer having multiple internal "stages" or "zones". A stage or zone is any discrete area within the dryer, and these terms are, used interchangeably herein. The process conditions within a stage may be different or similar to the other stages in the dryer. It is understood that two adjacent dryers are equivalent to a single dryer having multiple stages. The various feed streams of granules and coating material can be added at the different stages, depending on, for example, the particle size and moisture level of the feed stream. Feeding different streams to different stages can minimize the heat load on the dryer, and optimize the particle size and shape as defined herein.

Typically, the fluid bed mixer of the present invention comprises a first coating zone where the particle coating material of the present invention is applied. The coating zone involves the spraying of the coating material in aqueous or slurry form onto the fluidized particles. The bed is typically fluidized with heated air in order to dry or partially dry moisture from the spray coating as it is applied. The spraying is achieved via nozzles capable of delivering a fine or atomized spray of the coating mixture to achieve complete coverage of the particles. Typically, the droplet size from the atomizer is less than about 2 times the particle size. This atomization can be achieved either through a conventional two-fluid nozzle with atomizing air, or alternatively by means of a conventional pressure nozzle. To achieve this type of atomization, the solution or slurry theology is typically characterized by a viscosity of less than about 500 centipoise, preferably less than about 200 centipoise. While the nozzle location in the fluid bed may be in most any location, the preferred location is a positioning that allows a vertical down spray of the coating mixture such as a top spray configuration. To achieve best results, the nozzle location is placed at or above the fluidized height of the particles in the fluid bed. The fluidized height is typically determined by a weir or overflow gate height. The coating zone of the fluid bed is then typically followed by a drying zone and a cooling zone. Of course, one of ordinary skill in the art will recognize that alternative arrangements are also possible to achieve the resultant coated particles of the present invention.

Typical conditions within a fluid bed or agitated fluid bed apparatus of the present invention include (I) from about 1 to about 20 minutes of mean residence time, (ii) from about 100 to about 1200 mm of depth of unfluidized bed from the fluid bed plate or from 0 to about 600 mm from the top of fluid bed, (iii) a droplet size of less than 2 times the particle size preferably not more than about 100 micron of droplet spray size, more preferable not more than 50 micron, (iv) from about 150 to about 1600 mm of spray height, (v) from about 0.4 to about 4.0 m/s of fluidizing velocity and (vi) from about 12 to about 200° C. of bed temperature, preferably from about 12 to about 150° C., and even more preferably from about 12 to 100° C. Once again, one of ordinary skill in the art will recognize that the conditions in the fluid bed may vary depending on a number of factors.

The coated granules exiting the coating mixer may comprise in and of themselves a fully formulated detergent composition or in preferred embodiments may be admixed with additional ingredients, such as bleaching agents, enzymes, perfumes, non-coated detergent particles, and various other ingredients to produce a fully formulated detergent composition.

The coated granular detergent composition of the present invention achieves the desired benefits of solubility, improved aesthetics and flowability via the process of the present invention and the control or selection of the geometric mean particle diameter of certain levels of particles in the composition. By "improved aesthetics", it is meant that the consumer prefers a granular detergent product which has a more uniform appearance of particles as opposed to past granular detergent products which contained particles of varying size and composition. To that end, at least about 50%, more preferably at least about 75%, even more preferably at least about 90%, and most preferably at least about 95/by weight of the total particles in the detergent product, have the selected mean particle size diameter. In this way, a substantial portion of the granular detergent product will have the uniform size so as to provide the aesthetic appearance desired by consumers.

Preferably, the geometric mean particle diameter of the particles is from about 400 microns to about 1500 microns, more preferably from about 600 microns to about 1200 microns, and most preferably from about 600 microns;to about 1000 microns. The particle size distribution is defined by a relative tight geometric standard deviation or "span" so as not to have too many particles outside of the target size. Accordingly, the geometric standard deviation is preferably is from about 1 to about 2, more preferably is from about 1.0 to about 1.7, even more preferably is from about 1.0 to about 1.4, and most preferably is from about 1.0 to about 1.2. As can be recognized by one of ordinary skill in the art, the control of improperly sized particles via the present invention contributes to the tight span of the composition produced by the present invention.

While not intending to be bound by theory, it is believed that solubility is enhanced as a result of the particles in the detergent composition being more of the same size. Specifically, as a result of the particles being more uniform in size, the actual "contact points" among the particles in the detergent composition is reduced which, in turn, reduces the "bridging effect" commonly associated with the "lump-gel" dissolution difficulties of granular detergent compositions. Previous granular detergent compositions contained particles of varying sizes which leads to more contact points among the particles. For example, a large particle could have many smaller particles in contact with it rendering the particle site ripe for lump-gel formation. The level and uniform size of the particles in the granular detergent composition of the present invention avoids such problems.

By "a portion" of the particles, it is meant that at least some particles in the detergent composition contain a detersive surfactant and/or a detergent builder to provide the fundamental building blocks of a typical detergent composition. The various surfactants and builders as well as their respective levels in the composition are set forth hereinafter. Typically, the detergent composition will, contain from about 1% to about 50% by weight of a detersive surfactant and from about 1% to about 75% by weight of a detergent builder.

A particularly important attribute of detergent powders is color. Color is usually measured on a Hunter Colorimeter and reported as three parameters "L", "a" and "b". Of particular relevance to the powdered detergent consumer is the whiteness of the powder determined by the equation L-3b. In general, whiteness values below about 60% are considered poor. Whiteness can be improved by a number of means such as for example including a pigment or whitening agent in the coating layer of the granules such as titanium dioxide.

Another important attribute of the granular detergent products of this invention is the shape of the individual particles. Shape can be measured in a number of different ways known to those of ordinary skill in the art. One such method is using optical microscopy with Optimus (V5.0) image analysis software. Important calculated parameters are:

"Circularity" which is defined as (measured perimeter length of the particle image)$^2$/(measured area of the particle image). The circularity of a perfectly smooth sphere (minimum circularity) is 12.57; and "Aspect Ratio" which is defined as the length/width of the particle image.

Each of these attributes is important and can be averaged over the bulk granular detergent composition. And the combination of the two parameters as defined by the product of the parameters is important as well (i.e. both must be controlled to get a product with good appearance). Preferably, the granular detergent compositions produced by the process of the present invention have circularities less than about 50, preferably less than about 30, more preferably less than about 23, most preferably less than about 18. Also preferred are granular detergent compositions with aspect ratios less than about 2, preferably less than about 1.5, more preferably less than about 1.3 most preferably less than about 1.2.

Additionally, it is preferred to have a uniform distribution of shapes among the particles in the composition. Specifically, the granular detergent compositions of this invention have a standard deviation of the number distribution of circularity less than about 20, that is preferably less than about 10, more preferably less than about 7 most preferably less than about 4. And the standard deviation of the number distribution of aspect ratios is preferably less than about 1, more preferably less than about 0.5, even more preferably less than about 0.3, most preferably less than about 0.2.

In an especially preferred process of the present invention, granular detergent compositions are produced wherein the product of circularity and aspect ratio is less than about 100, preferably less than about 50, more preferably less than about 30, and most preferably less than about 20. Also preferred are granular detergent compositions with the standard deviation of the number distribution of the product of circularity and aspect ratio of less than about 45, preferably less than about 20, more preferably less than about 7 most preferably less than about 2.

As previously stated, the coated particles of the present invention have improved surface properties in that the particles are more uniform in shape and smoother on the surface than the uncoated spray-dried or agglomerated detergent particles. These features are reflected in a reduction of the overall surface area of particles having the coating of the present invention as opposed to particles not having the coatings of the present invention. The coatings of the present invention reduce total surface area by smoothing irregularities and filling crevices on the surface of the particles. The coatings of the present invention provide a reduction in overall surface area as measured by the formula:

(Surface Area of Non-Coated Particles)−(Surface Area of Coated Particles)/(Surface Area of Non-Coated Particles)*100=Percent of Surface Area Reduction of at least about 10%, more preferably at least about 20% and most preferably at least about 30%. A reduction in surface area as provided by the present invention leads to improved flow properties and to improved overall aesthetics by providing a more reflective surface.

Surface Area Test Method

The surface area of the particles of the present invention are measured according to the following procedure. Detergent Particles are placed into a Micromeritics VacPrep 061, available from Micromeritics of Norcross, Georgia, for pre-test preparation. The particles are placed under a vacuum of approximately 500 millitorr and heated to a temperature of between 80 and 100° C. for approximately 16 hours. The BET multi-point surface area is then measured in a Micromeritics Gemini 2375 surface area analyzer using a mixture of helium and nitrogen gases and the following general conditions: Evacuation rate—500.0 mmHg/min; Analysis Mode—Equilibration; Evacuation Time—1.0 min.; Saturation Pressure—771.77 mmHg; Equilibration Time—5 sec. Helium/Nitrogen Pressure—15 psig; Helium and Nitrogen purity 99.9%, free space is measured and P/Po points cover 0.05 to 0.3 with 5 data points taken.

The preferred detergent compositions of this invention meet at least one and most preferably all, of the attribute measurements and standard deviations as defined above, that is for whiteness, color uniformity circularity, percent surface area reduction and aspect ratio.

In an optional embodiment of the present invention, the coated particles of the present invention may be treated with a post coating gloss treatment to provide a gloss layer on the coated detergent particle. The gloss layer may comprise inorganic salt materials, chelating materials, polymeric materials and mixtures thereof. Preferred inorganic materials are sulfate salts such as magnesium sulfate, preferred chelants are diamines such as ethylene diamine disuccinic acids (EDDS), while preferred polymers include acrylic polymers and copolymers such as acrylic/maleic copolymers.

Detergents Components

Fully formulated detergent compositions of the present invention may include any number of conventional detergent ingredients. For example, the surfactant system of the detergent composition may include anionic, nonionic, zwitterionic, ampholytic and cationic classes and compatible mixtures thereof. Detergent surfactants are described in U.S. Pat. No. 3,664,961, Norris, issued May 23, 1972, and in U.S. Pat No. 3,919,678, Laughlin et al., issued Dec. 30, 1975, both of which are incorporated herein by reference. Cationic surfactants include those described in U.S. Pat. No. 4,222,905, Cockrell, issued Sep. 16, 1980, and in U.S. Pat. No. 4,239,659, Murphy, issued Dec. 16, 1980, both of which are also incorporated herein by reference.

Nonlimiting examples of surfactant systems include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y$ $(CHOSO_3^-M^+)$ $CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates). $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the surfactant system. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_1$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts.

The detergent composition can, and preferably does, include a detergent builder. Builders are generally selected from the various water-soluble, alkali metal, ammonium or substituted ammonium phosphates, polyphosphates, phosphonates, polyphosphonates, carbonates, silicates, borates, polyhydroxy sulfonates, polyacetates, carboxylates, and polycarboxylates. Preferred are the alkali metal, especially sodium, salts of the above. Preferred for use herein are the phosphates, carbonates, silicates, $C_{10-18}$ fatty adds, polycarboxylates, and mixtures thereof. More preferred are sodium tripolyphosphate, tetrasodium pyrophosphate, citrate, tartrate mono- and di-succinates, sodium silicate, and mixtures thereof (see below).

Specific examples of inorganic phosphate builders are sodium and potassium tripolyphosphate, pyrophosphate, polymeric metaphosphate having a degree of polymerization of from about 6 to 21, and orthophosphates. Examples of polyphosphonate builders are the sodium and potassium salts of ethylene diphosphonic acid, the sodium and potassium salts of ethane 1-hydroxy-1,1-diphosphonic acid and the sodium and potassium salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, all of which are incorporated herein by reference.

Examples of nonphosphorus, inorganic builders are sodium and potassium carbonate, bicarbonate, sesquicarbonate, tetraborate decahydrate, and silicates having a weight ratio of $SiO_2$ to alkali metal oxide of from about 0.5 to about 4.0, preferably from about 1.0 to about 2.4. Water-soluble, nonphosphorus organic builders useful herein include the various alkali metal, ammonium and substituted ammonium polyacetates, carboxylates, polycarboxylates and polyhydroxy sulfonates. Examples of polyacetate and polycarboxylate builders are the sodium, potassium, lithium, ammonium and substituted ammonium salts of ethylene diamine tetraacetic acid, nitrilotriacetic acid, oxydisuccinic acid, mellitic acid, benzene polycarboxylic adds, and citric acid.

Polymeric polycarboxylate builders are set forth in U.S. Pat. No. 3,308,067, Diehl, issued Mar. 7, 1967, the disclosure of which is incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid. Some of these materials are useful as the water-soluble anionic polymer as hereinafter described, but only if in intimate admixture with the nonsoap anionic surfactant.

Other suitable polycarboxylates for use herein are the polyacetal carboxylates described in U.S. Pat. No. 4,144,226, issued Mar. 13, 1979 to Crutchfield et al., and U.S. Pat. No. 4,246,495, issued Mar. 27, 1979 to Crutchfield et al., both of which are incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, converted to the corresponding salt, and added to a detergent composition. Particularly preferred polycarboxylate builders are the ether carboxylate builder compositions comprising a combination of tartrate monosuccinate and tartrate disuccinate described in U.S. Pat. No. 4,663,071, Bush et al., issued May 5, 1987, the disclosure of which is incorporated herein by reference.

Water-soluble silicate solids represented by the formula $SiO_2.M_2O$, M being an alkali metal, and having a $SiO_2:M_2O$ weight ratio of from about 0.5 to about 4.0, are useful salts in the detergent granules of the invention at levels of from about 2% to about 15% on an anhydrous weight basis, preferably from about 3% to about 8%. Anhydrous or hydrated particulate silicate can be utilized, as well.

Any number of additional ingredients can also be included as components in the granular detergent composition. These include other detergency builders, bleaches, bleach activators, suds boosters or suds suppressors, anti-tarnish and anti-corrosion agents, soil suspending agents, soil release agents, germicides, pH adjusting agents, non-builder alkalinity sources, chelating agents, smectite clays, enzymes, enzyme-stabilizing agents and perfumes. See U.S. Pat. No. 3,936,537, issued Feb. 3, 1976 to Baskerville, Jr. et al., incorporated herein by reference.

Bleaching agents and activators are described in U.S. Pat. No. 4,412,934, Chung et al., issued Nov. 1, 1983, and in U.S. Pat. No. 4,483.781, Hartman, issued Nov. 20, 1984, both of which are incorporated herein by reference. Chelating agents are also described in U.S. Pat. No. 4,663,071, Bush et al., from Column 17, line 54 through Column 18, line 68, incorporated herein by reference. Suds modifiers are also optional ingredients and are described in U.S. Pat. No. 3,933,672, issued Jan. 20, 1976 to Bartoletta et al., and 4,136,045, issued Jan. 23, 1979 to Gault et al., both incorporated herein by reference.

Suitable smectite clays for use herein are described in U.S. Pat. No. 4,762,645, Tucker et al., issued Aug. 9, 1988, Column 6, line 3 through Column 7, line 24, incorporated herein by reference. Suitable additional detergency builders for use herein are enumerated in the Baskerville patent, Column 13, line 54 through Column 16, line 16, and in U.S. Pat. No. 4,663,071, Bush et al., issued May 5, 1987, both incorporated herein by reference.

The following examples are presented for illustrative purposes only and are not to be construed as limiting the scope of the appended claims in any way.

EXAMPLES

In the following examples all levels are quoted as % by weight of the composition:

Example I

A detergent composition having base granules of the following formula is produced via a conventional spray drying process:

| | |
|---|---|
| NaLAS | 29.58 |
| NaAS | 5.23 |
| Cationic (CocoK3) | 1.51 |
| ML-9 | 13.80 |
| Sodium silicate 2R | 15.06 |
| Brighteners | 0.35 |
| Sodium carbonate | 20.67 |
| Zeolite A | 4.43 |
| Miscellaneous | 5.62 |
| Moisture | 3.75 |
| Total | 100.00 |

The spray-dried granules are compacted in a roll compactor at 60–110 bars compaction pressure and the resultant compacted sheet is ground in a cage mill or Fitz mill. The compacted and ground particles are then coated with a surfactant containing coating medium in a moderate-speed mixer (KM-600™). The average residence time is 5 minutes and the surfactant containing paste is added at 60 deg.C. A Tulip type of chopper is used in the mixer to disperse the coating medium and to chop any lumps formed during the coating process. A coated detergent composition having the following formula is obtained:

| | A | B | C | D |
|---|---|---|---|---|
| Base granule | 79.69 | 77.39 | 75.55 | 77.17 |
| Coating Material | | | | |
| 60% active paste[1] | — | 6.01 | — | — |
| 51% total active mixture (90/10) paste[2] | — | — | 7.56 | — |
| 40% active solution[3] | — | — | — | 5.80 |
| 20% Sodium sulfate solution | 2.02 | — | — | — |
| Zeolite on Coated Granules | 6.70 | 5.01 | 6.35 | 6.49 |
| Bleach activator (NOBS) | 4.00 | 4.00 | 4.00 | 4.00 |
| Coated Sodium Percarbonate | 4.50 | 4.50 | 4.50 | 4.50 |
| Soil Release Polymers | 0.34 | 0.34 | 0.34 | 0.34 |
| Suds suppressor | 1.00 | 1.00 | 1.00 | 1.00 |
| Layered sodium silicate | 1.05 | 1.05 | — | — |
| Protease enzyme | 0.50 | 0.50 | 0.50 | 0.50 |
| Perfume | 0.20 | 0.20 | 0.20 | 0.20 |
| Total | 100.00 | 100.00 | 100.00 | 100.00 |

[1]sodium linear alkyl benzene sulfonate
[2]sodium linear alkyl benzene sulfonate and sodium xylene sulfonate
[3]sodium xylene sulfonate or disodium alkyldiphenyloxide disulfonate (commercially known as Dowfax hydrotrope with the alkyl group having a chainlength from C1–C10)

In all the examples that follow, the spray-dried granule is comprised of 11% surfactant, 74% inorganic salts, 5% polyacrylate polymer, 5% soap, and 5% moisture. The dry agglomerate composition is comprised of 30% surfactant, 62% inorganic salts, 4% sodium aluminosilicate, and 4% moisture. The following are examples of processes for obtaining dust-free high density granules with narrower particle size distribution, improved flowability and better solubility. The resulting coated composition has a geometric mean particle diameter of from about 400 to 1500 microns with a geometric standard deviation of from about 1 to about 2, unless otherwise indicated.

Example II

Step 1

360 kgs/hr of a spray-dried granule (particle size of 400 microns, bulk density of 400 g/l) and 360 kgs/her of a dry agglomerate (particle size of 450 microns, bulk density of 780 g/l) is introduced into a moderate-speed mixer KM-600™ Lodige Mixer with 8 serrated ploughs and 4 christmas-tree choppers mounted perpendicular to the ploughs along the length of the mixer. The mixer is divided into four zones. The gap between the ploughs and the wall of the mixer is about 3 cms. The wall temperature is maintained at 30° C.

Step 2

105–115 kgs/hr of aqueous linear alkyl benzene sulphonate paste (C11–C18, 60% active) is dispersed by the first chopper into the mixer and 70 kgs/hr of crystalline sodium aluminosilicate is added in the last zone of the mixer. The surfactant paste is fed at 50° C. and the powders are fed at room temperature. The condition of the moderate-speed mixer KM-600 is as follows:

Mean residence time: 7.5–10 minutes

Tip Speed: 2–3 m/s

Power Draw: 20–500 W/kg

Chopper RPM: 3600

The resulting granules have a bulk density of 750–850 g/l. The geometric mean particle size diameter is 450 microns.

Example III

Step 1

800 grams of a spray-dried granule (particle size of 400 microns, bulk density of 400 g/l) is premixed for 2 minutes in a Processal™ Tilt-a-plow bench-scale Mixer with total volume of 4 litres. This mixer is equipped with standard ploughs and one tulip-shaped chopper bottom-mounted in the centre of the mixer.

Step 2

200 grams of aqueous linear alkyl benzene sulphonate paste (C11–C18, 60% active) is injected into the mixer and dispersed with the action of the chopper blades on the powders over a period of 5 minutes. The paste is at 50° C. and the powders are at room temperature.

Step 3

After the paste is added, mixing is continued for 2.5 minutes and then 100 grams of crystalline sodium aluminosilicate is added into the mixer. Mixer Operating Conditions are as follows:

Total batch time: 15 minutes

Tip Speed: 0.5–1 m/s

Chopper RPM: 3600

After mixing further for 3 minutes, the contents are fed into a fluidized bed for drying. The inlet air temperature is 105° C., air velocity is 0.6 m/s and drying time is 5 minutes.

The resulting granules have a bulk density of 750–850 g/l. The geometric mean particle diameter is 500 microns.

Example IV

Step 1

360 kgs/hr of a spray-dried granule (particle size of 400 microns, bulk density of 400 g/l) and 360 kgs/her of a dry agglomerate (particle size of 450 microns, bulk density of 780 g/l) is introduced into a high-speed Schugi Mixer. 40 kgph of aqueous linear alkyl benzene sulphonate paste (C11–18, 30% active) is sprayed on the powders using a SU 26 two-fluid nozzle (air pressure: 1–5 kg/cm$^2$, liquid pressure: 2–3 kg/cm$^2$). The liquid is sprayed on at 50° C. and the powders are at room temperature. The operating conditions of the high-speed Schugi Mixer are as follows:

Tip Speed: 24 m/s

Mean residence Time: 0.1–1 second

Power Draw: 1–5 kW/kg

Step 2

The output from the Schugi is fed into a moderate-speed mixer KM-600™ Mixer and 60 kgph of aqueous linear alkyl benzene sulphonate paste (C11–C18, 60% active) is dispersed by the first chopper into the moderate-speed mixer and 70 kgs/hr of crystalline sodium aluminosilicate is added in the last zone of the mixer. The surfactant paste is fed at 50° C. The condition of the moderate-speed mixer KM-600 is as follows:

Mean residence time: 2–3 minutes

Tip Speed: 2–3 m/s

Power Draw: 20–500 W/kg

Chopper RPM: 3600

Step 3

The product from the moderate-speed mixer KM-600™ is subjected to conditioning operations of gas-fluidized bed drying, gas-fluidized bed cooling and sizing. The inlet air temperature in the dryer is 120° C. and the air velocity is 1 m/s. Inlet air humidity in the dryer is 10%. The inlet air temperature in the cooler is 10° C., the air velocity is 1 m/s and the inlet air humidity is 40%.

The resulting granules have a bulk density of 750–850 g/l.

Example V

Step 1

360 kgs/hr of a spray-dried granule (particle size of 400 microns, bulk density of 400 g/l) and 360 kgs/her of a dry agglomerate (particle size of 450 microns, bulk density of 780 g/l) is introduced into a high-speed Schugi Mixer. 40 kgph of aqueous linear alkyl benzene sulphonate paste (C11–18, 30% active) is sprayed on the powders using a SU 26 two-fluid nozzle (air pressure: 1–5 kg/cm$^2$, liquid pressure: 2–3 kg/cm$^2$). The liquid is sprayed on at 50° C. and the powders are at room temperature. The operating conditions of the Schugi Mixer are as follows:

Tip Speed: 24 m/s

Mean residence Time: 0.1–1 second

Power Draw: 1–5 kW/kg

Step 2

The output from the Schugi is fed into a moderate-speed mixer KM-600™ and 40 kgph of aqueous linear alkyl benzene sulphonate paste (C11–C18, 60% active) is dispersed by the first chopper into the moderate-speed mixer and 50 kgs/hr of crystalline sodium aluminosilicate is added in the last zone of the mixer. The surfactant paste is fed at 50° C. The condition of the moderate-speed mixer KM-600™ is as follows:

Mean residence time: 2–3 minutes

Tip Speed: 2–3 m/s

Power Draw: 20–500 W/kg

Chopper RPM: 3600

Step 3

The product from the moderate-speed mixer KM-600™ is fed into a second high-speed Schugi Mixer. 20 kgph of aqueous polyethylene glycol solution (mol.wt.:4000, 40% active) is sprayed on the powders using a SU 26 two-fluid nozzle (air pressure: 1–5 kg/cm$^2$, liquid pressure: 2–3 kg/cm$^2$). The liquid is sprayed on at 50° C. The operating conditions of the Schugi Mixer are as follows:

Tip Speed: 24 m/s

Mean residence Time: 0.1–1 second

Power Draw: 1–5 kW/kg

Step 4

The output from the Schugi is subjected to conditioning operations of gas-fluidized bed drying, gas-fluidized bed cooling and sizing. The inlet air temperature in the dryer is 120° C. and the air velocity is 1 m/s. Inlet air humidity in the dryer is 10%. The inlet air temperature in the cooler is 10° C., the air velocity is 1 m/s and the inlet air humidity is 40%.

The resulting granules have a bulk density of 750–850 g/l.

Example VI

Step 1

360 kgs/hr of a spray-dried granule (particle size of 400 microns, bulk density of 400 g/l) and 360 kgs/her of a dry agglomerate (particle size of 450 microns, bulk density of 780 g/l) is introduced into a moderate-speed mixer KM-600™. 60 kgph of aqueous linear alkyl benzene sulphonate paste (C11–C18, 60% active) is dispersed by the first chopper into the mixer and 50 kgs/hr of crystalline sodium aluminosilicate is added in the last zone of the mixer. The surfactant paste is fed at 50° C. and the powders are at room temperature. The condition of the moderate-speed mixer KM-600™ is as follows:

Mean residence time: 2–3 minutes

Tip Speed: 2–3 m/s

Power Draw: 20–500 W/kg

Chopper RPM: 3600

Step 2

The output from the moderate-speed mixer KM-600™ is fed into a high-speed Schugi and 40 kgph of aqueous polyethylene glycol solution (mol.wt.:4000, 40% active) is sprayed on the powders using a SU 26 two-fluid nozzle (air pressure: 1–5 kg/cm$^2$, liquid pressure: 2–3 kg/cm$^2$). The liquid is sprayed on at 50° C. The operating conditions of the high-speed Schugi Mixer are as follows:

Tip Speed: 24 m/s

Mean residence Time: 0.1–1 second

Power Draw: 1–5 kW/kg

Step 3

The product from the Schugi is subjected to conditioning operations of gas-fluidized bed drying, gas-fluidized bed cooling and sizing. The inlet air temperature in the dryer is 120° C. and the air velocity is 1 m/s. Inlet air humidity in the dryer is 10%. The inlet air temperature in the cooler is 10° C., the air velocity is 1 m/s and the inlet air humidity is 40%.

The resulting granules have a bulk density of 750–850 g/l.

Example VII

Step 1

360 kgs/hr of a spray-dried granule (particle size of 400 microns, bulk density of 400 g/l) and 360 kgs/her of a dry agglomerate (particle size of 450 microns, bulk density of 780 g/l) is introduced into a moderate-speed KM-600™ Lodige Mixer with 8 serrated ploughs and 4 christmas-tree choppers mounted perpendicular to the ploughs along the length of the mixer. The mixer is divided into four zones. The gap between the ploughs and the wall of the mixer is about 3 cms. The wall temperature is maintained at 30° C.

Step 2

105–115 kgs/hr of aqueous C16–C17 branched alkyl sulphate/C14C15 linear alkyl sulphate paste (ratio of 60:40, 50% active) is dispersed by the first chopper into the mixer and 70 kgs/hr of crystalline sodium aluminosilicate is added in the last zone of the mixer. The surfactant paste is fed at 50° C. and the powders are fed at room temperature. The condition of the KM-600™ mixer is as follows:

Mean residence time: 7.5–10 minutes

Tip Speed: 2–3 m/s

Power Draw: 20–500 W/kg

Chopper RPM: 3600

Step 3

The product from the KM-600™ is subjected to conditioning operations of gas-fluidized bed drying, gas-fluidized bed cooling and sizing. The inlet air temperature in the dryer is 120° C. and the air velocity is 1 m/s. Inlet air humidity in the dryer is 10%. The inlet air temperature in the cooler is 10° C., the air velocity is 1 m/s and the inlet air humidity is 40%.

Having thus described the invention in detail, it will be obvious to those skilled in the art that various changes may be made without departing from the scope of the invention and the invention is not to be considered limited to what is described in the specification.

What is claimed is:

1. A process for preparing a coated granular detergent composition comprising the steps of:

i) providing a granular detergent composition having granules containing detergent active materials;

ii) passing said detergent granules to a coating mixer;

iii) providing a coating solution of a water soluble coating material, wherein the water soluble coating material is a mixture of an anionic surfactant and a hydrotrope, wherein a) the anionic surfactant is selected from the group consisting of sodium linear alkyl benzene sulfonate, hydrophobic secondary alkyl sulfate mixture thereof;

b) the hydrotrope is selected from the group consisting of sodium xylene sulfonate, alkyldiphenyloxide disulfonate having alkyl group chain length of from C1–C10, and mixture thereof; and c) the ratio of surfactant to hydrotrope is from about 70:30 to about 95:5; and iv) at least partially coating said granules in said coating mixer to form a coated detergent granular composition;

wherein said coated detergent composition has a geometric mean particle diameter of from about 400 microns to about 1500 micorons with a geometric standard deviation of from about 1 to about 2.

2. The process as claimed in claim 1 wherein said coating mixer is selected from the group consisting of low speed mixers, fluid bed mixers, and combinations thereof.

3. The process as claimed in claim 1 wherein said coating materials further includes a detergent supplements such as brighteners, chelants, nonionic surfactants, co-builders and mixtures thereof.

4. The process as claimed in claim 1 wherein said step of providing said aqueous coating solution further comprises the step of spraying said coating solution into said coating mixer.

5. The process as claimed in claim 4 wherein the amount of coating solution is from about 1% to about 30%, by weight, of the detergent composition.

6. The process as claimed in claim 1 further comprising the steps of mixing said coated detergent granules with a flow control aid to adhere said flow control aid to the surface of said granules.

7. The process as claimed in claim 6 wherein the flow control aid is an inorganic powder material and is selected from the group consisting of crystalline layered silicate, carbonate, sodium sulfate, aluminosilicate, magnesium silicate, calcium silicate, clay, and mixtures thereof.

8. A granular detergent composition produced by the process of claim 1.

9. A process for preparing a coated granular detergent composition comprising the steps of:

i) providing a granular detergent composition having granules containing detergent active materials;

ii) passing said detergent granules to a coating mixer;

iii) providing a coating solution of a water soluble coating material, wherein the water soluble coating material is a mixture of an anionic surface and a hydrotrope, wherein a) the anionic surfactant is selected from the group consisting of sodium linear alkyl benzene sulfonate, hydrophobic secondary alkyl sulfate and mixtures thereof; and b) the hydrotrope is selected from the group consisting of sodium xylene sulfonate, alkyldiphenyloxide disulfonate having an alkyl chain length of from C1–10, and mixtures thereof; and c) the ratio of surfactant to hydrotrope is from about 70:30 to about 95:5 and iv) at least partially coating said granules in said coating mixer to form a coated detergent granular composition.

10. The process as claimed in claim 9, wherein said coating mixer is selected from the group consisting of low speed mixers, fluid bed mixers, and combinations thereof.

11. The process as claimed in claim 9 further comprising the steps of mixing said coated detergent granules with a flow control aid to adhere said flow control aid to the surface of said granules.

12. The process as claimed in claim 11 wherein the flow control aid is an inorganic powder material and is selected from the group consisting of crystalline layered silicate, carbonate, sodium sulfate, aluminosilicate, magnesium silicate, calcium silicate, clay, undersized detergent particles and mixtures thereof.

13. A granular detergent composition produced by the process of claim 9.

* * * * *